United States Patent [19]

Meggs

[11] Patent Number: 4,482,081

[45] Date of Patent: Nov. 13, 1984

[54] WATER ACTIVATED INFLATION MECHANISM

[75] Inventor: Daniel H. Meggs, La Mirada, Calif.

[73] Assignee: Gulf & Western Manufacturing Company, Southfield, Mich.

[21] Appl. No.: 430,536

[22] Filed: Sep. 30, 1982

[51] Int. Cl.[3] ..... B67B 7/24

[52] U.S. Cl. ..... 222/5; 222/54; 441/98

[58] Field of Search ..... 222/5, 54; 441/95, 97, 441/93, 101, 31, 98

[56] References Cited

U.S. PATENT DOCUMENTS

| | | | |
|---|---|---|---|
| 2,349,480 | 5/1944 | Walk | 222/5 |
| 2,513,347 | 7/1950 | Myers | 222/5 |
| 3,246,801 | 4/1966 | De Boer | 222/5 |
| 3,934,292 | 1/1976 | Mulderrig | 222/5 |

*Primary Examiner*—H. Grant Skaggs

[57] ABSTRACT

An inflation mechanism is provided for automatically inflating a life preserver or the like upon immersion in water. The mechanism includes a housing, a first piston slidably mounted within the housing, a second piston slidably mounted within the first piston, and a water-activated chemical positioned in a chamber between the two pistons. Upon immersion in water, the chemical reacts therewith creating a gaseous end product. The pistons are forced apart by the gas. One of them includes a piercing pin for puncturing the membrane of a $CO_2$ cartridge. If the mechanism is not totally immersed in water, the piston including the piercing pin is restricted from moving through the membrane.

10 Claims, 7 Drawing Figures

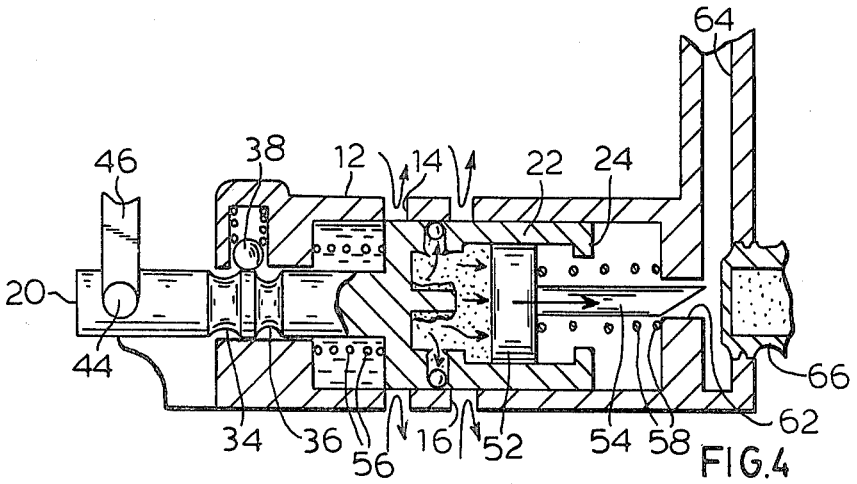
FIG.4
FIG.5
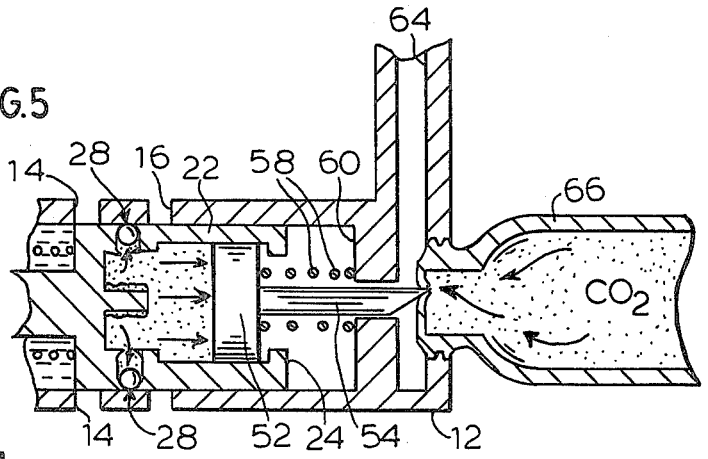
FIG.6
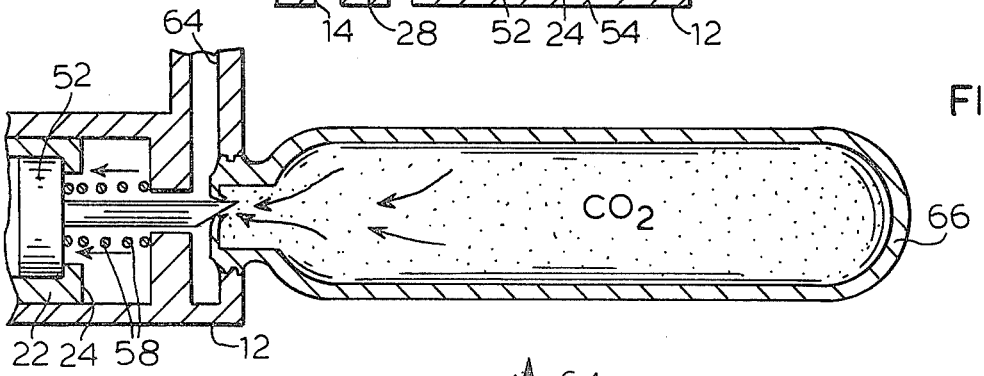
FIG.7
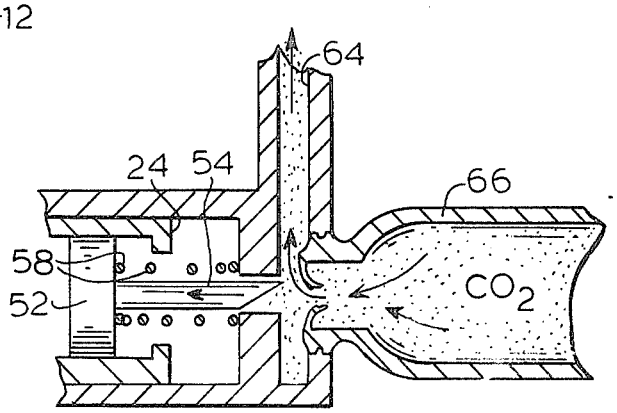

WATER ACTIVATED INFLATION MECHANISM

BACKGROUND OF THE INVENTION

1. The field of the invention relates to a water activated inflation mechanism for use with life rafts, life preservers, and the like.

2. Brief description of the prior art

Inflation devices have been used for manually and/or automatically causing the inflation of life rafts, preservers, and belts. Due to the fact that accidents upon a body of water may incapacitate an individual, automatically operated devices are often desirable.

One type of automatically operated device includes a water-activated chemical such as carbide pellets for actuation. Upon contact with the water, the chemical releases gas which causes the actuation of a plunger or the like. The plunger is in some way responsible for the puncturing of the seal of a compressed gas cartridge filled with a gas such as carbon dioxide. The expanding gas from the cartridge fills the inflatable member. U.S. Pat. No. 2,349,480 describes an apparatus which operates generally in this manner.

Inflatable safety devices may be stored for considerable periods of time prior to use. They may also be subject to adverse weather conditions on occasion. It is accordingly important that an automatically operable device not be actuated prematurely.

SUMMARY OF THE INVENTION

A water activated inflation mechanism is provided which will operate automatically upon immersion in water. Means are provided for preventing operation when the mechanism is merely sprayed with water or subjected to extreme humidity conditions.

A water-activated chemical is provided for causing a piston having a piercing pin to move towards a compressed-gas cartridge upon immersion in water. The pin is adapted for puncturing the seal of the cartridge. If the chemical is activated in some manner other than substantially total immersion, movement of the piston towards the cartridge is limited so that puncturing does not occur.

Means for operating the mechanism manually may also be provided.

BRIEF DESCRIPTION OF THE DRAWINGS

FIGS. 2–7 are sequential sectional views illustrating portions of the mechanism shown in FIG. 1 after immersion in water.

DETAILED DESCRIPTION OF THE INVENTION

Figure 1:
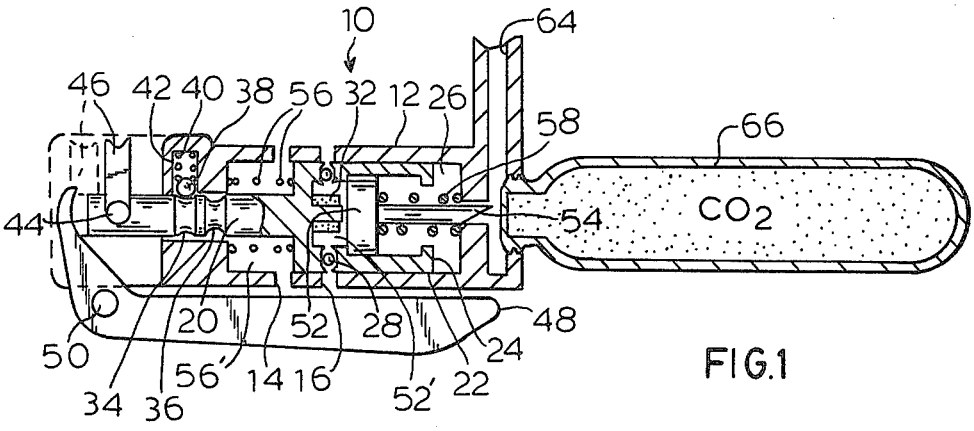
FIG. 1 is a sectional view illustrating an inflation mechanism according to the invention.

Referring to the figures, an inflation mechanism 10 is provided having a housing 12 defining a substantially cylindrical chamber therein. Two pairs of ports 14,16 within the housing walls establish fluid communication between the chamber and the atmosphere. One pair of ports is longitudinally displaced from the other with respect to the axis of the chamber.

A slidable piston 18 comprising a shaft 20 and an enlarged hollow cylindrical portion 22 are positioned within the housing chamber. The external diameter of the cylindrical portion 22 is substantially equal to the diameter of this chamber. The walls thereof include an inwardly projecting flange 24 which together define a cylindrical piston chamber 26.

A pair of ports are provided within the cylindrical portion 22 of the piston 18. Each includes a one-way valve 28 which allows a liquid to pass into the chamber 26 but not out. The valves 28 are ordinarily aligned with one pair of ports 16 within the housing when the mechanism 10 is in storage prior to actuation.

A cylindrical projection 30 extends into chamber 26 from an end face defined by a piston surface. An annular water-activated chemical member 32 is positioned about the projection. When contacted by water, the chemical reacts to form a non-explosive gas.

The piston shaft 20 includes first and second notches 34,36 and a flat area of selected length separating them. A ball detent 38 is urged towards the notches 34,36 by a coil spring 40 positioned within a cylindrical bore 42 within the housing.

A lug 44 extends from one end of the piston shaft 20. A slidable connecting member 46 enables one to manually move the piston 18 to the left so that ball detent 38 engages notch 36. The member 46 is shown in phantom in FIG. 1 in the latter position. It may either engage the lug 44 or extend directly from the shaft.

A lever 48 which is pivotable upon a pin 50 is provided for manual operation. The lever is generally L-shaped having one segment capable of contacting lug 44 upon rotation about pin 50.

A second piston 52 is slidably positioned within the chamber 26 defined in piston 18. It includes a large end having nearly the same diameter as the chamber and a piercing pin 54 extending perpendicularly therefrom. The piercing pin faces the open end of the chamber. Movement of the second piston is restricted in one direction by shoulder 55 and in the opposite direction by flange 24. A chamber 52' is defined by the large end of the second piston and the interior walls of portion 22.

The first piston 18 is urged in one direction by a first coil spring 56 positioned in chamber 56' having ends abutting it and the housing 12. The second piston 52 is urged in the opposite direction by a second coil spring 58 having ends abutting its large end and the housing 12. The second spring 58 is made from heavier gauge wire than the first and is according relatively stiff in comparison thereto.

One end of the housing 12 includes an end wall 60 having a central opening 62 through which the piercing pin 54 may pass. The opening 62 extends between the housing chamber and a flow passage 64 connected to the bladder of a life preserver or raft (not shown). A carbon dioxide cartridge 66 is mounted to the housing 12 directly across the passage 64 from the opening 62 so that it can be punctured by the piercing pin 54.

The mechanism 10 as shown and described herein is intended to automatically inflate a life preserver or the like when it is submersed in water. The operation is automatic so that it takes place whether the wearer is conscious or not, and it cannot be inadvertently activated by rain, moisture, or humidity. A manual actuation mechanism is also provided.

Upon immersion of unit, water enters through ports 14 and 16, filling chambers 56' and 52' completely. The chemical 32 is activated to form an expanding gas which is preferably non-explosive.

The pressure thereby created within chamber 56' closes valves 28. Further expansion tends to move both pistons 18 and 52 in opposite directions parallel to the axis of housing 12. Because spring 56 is much lighter than spring 58, piston 52 remains essentially stationary while piston 18 moves to the left. A small amount of movement of piston 18 closes the ports 14 preventing any further movement of water therethrough. At this point, chamber 56' becomes a closed chamber which is full with water. The water entrapped is virtually incompressible preventing further movement of piston 18, and since the gas in chamber 52' is continuing its expansion, piston 52 is caused to move rapidly to the right, overcoming resistance of spring 58 such that the sharp tip of pin 54 pierces the cartridge membrane, releasing pressurized gas from cylinder 66 to inflate the life-preserving bladder.

Figure 2:
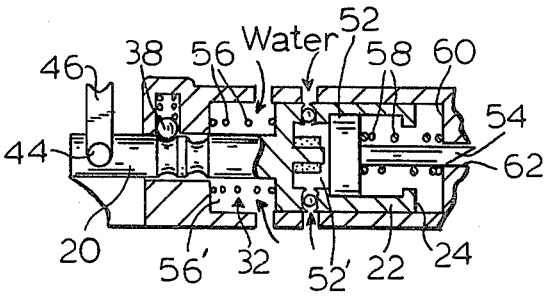
Figure 3:
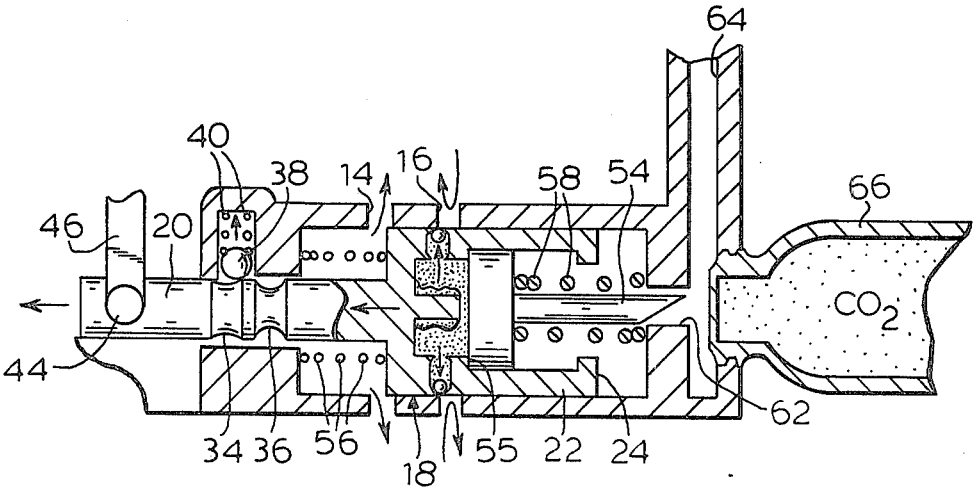

Referring now to the figures, FIG. 1 illustrates the mechanism 10 prior to actuation. Ball detent 38 is engaged in notch 34 and ports 14 and 16 are positioned to allow fluid communication between the interior and exterior of the housing 12. Upon immersion, water enters the mechanism as shown in FIG. 2 thereby activating the chemical 32. Piston 18 immediately begins to move (FIG. 3) until ports 14 are closed off (FIG. 4). Piston 52 then moves towards cartridge 66 until its membrane is punctured (FIGS. 5–6). The combined forces of spring 58 and the escaping gas from the cartridge cause the piston 52 to retract slightly, thereby improving flow through passage 64 to the bladder.

To prevent accidental initiation of chemical reaction, the chemical 32 or surface thereof, is preferably relatively impervious to changes in humidity. Valves 28, though allowing water to pass therethrough, are small enough to have an inhibiting effect upon the passage of individual water droplets. Even if actuation occurs by means other than total immersion, the air remaining in chamber 56' will be compressible. This allows piston 18 to move further into chamber 56' than if it were filled with water. Movement occurs until ball detent 38 engages notch 36. At this point, movement of piston 52 towards the cartridge 66 is restricted by flange 24. Piercing of the cartridge membrane accordingly cannot occur.

The slidable member 46 enables one to manually move shaft 20 away from the cartridge until ball 38 engages notch 36. This prevents subsequent automatic actuation.

The mechanism 10 can be manually activated by any time by pulling outwardly on lever 48. Pressure is exerted on lug 44 which, being fixedly mounted to shaft 20, causes both pistons 18,52 to move towards the cartridge 66.

It will be understood that various seals and O-rings are provided where necessary within the mechanism 10. They are omitted from the drawings for purposes of clarity. A safety device such as a pull-ring or a shear pin may be incorporated to prevent accidental manual actuation.

What is claimed is:

1. An inflation mechanism comprising:

a cartridge of compressed gas;

a housing, said cartridge being mounted to said housing;

means for puncturing said cartridge including a piercing pin;

a first chamber within said housing including a water-actuable chemical therein which produces a gas upon contact with water;

a second chamber within said housing;

a piston slidably mounted within said housing, said piercing pin being mounted to said piston, a wall of said first chamber being defined by said piston such that said piston is urged towards said cartridge when gas is produced by the reaction of said chemical with water;

a movable wall within said housing defining a wall of said second chamber, said movable wall being urged away from said cartridge upon the production of gas when said chemical reacts with water;

means for allowing the entrance of water into said first chamber;

means for allowing the entrance of water into said second chamber and means for preventing the exit of water therefrom, said piston being capable of moving closer to said cartridge when said second chamber is filled with water than when it is not.

2. A mechanism as defined in claim 1 including:

a first piston slidably mounted within said housing, said first piston including said movable wall and a hollow cylindrical portion extending therefrom;

said piston being slidably mounted within said hollow cylindrical portion of said first piston;

said first chamber being defined within said hollow cylindrical portion of said first piston and between said pistons; and said second chamber being defined by said first piston and said housing.

3. A mechanism as defined in claim 2 wherein said first piston includes a projection extending within said hollow cylindrical portion for restraining movement of said piston therein.

4. A mechanism as defined in claim 3 including means for engaging said first piston and said housing.

5. A mechanism as defined in claim 4 wherein said means for engaging said first piston and said housing includes a shaft connected to said hollow cylindrical portion of said first piston, at least one notch within said shaft, and engagement means resiliently urged towards said notch.

6. A mechanism defined in claims 2 or 5 including a first spring urging said first piston in the direction of said cartridge, a second spring urging said piston away from said cartridge, said first spring having a smaller spring constant than said second spring.

7. A mechanism as defined in claim 6 including first and second ports within said housing; a port including a one-way valve within a wall of said hollow cylindrical portion of said first piston for allowing liquid flow into but not out of said first chamber, one of said ports within said housing allowing liquid flow into said first chamber, the other of said ports within said housing being the means allowing the entrance of water into said second chamber.

8. A mechanism as defined in claim 1 including a first spring urging said movable wall in the direction of said cartridge, a second spring urging said piston away from said cartridge, said first spring having a smaller spring constant than said second spring.

9. An inflation mechanism comprising:

a housing;

a first piston slidably mounted within said housing, said first piston including a hollow cylindrical portion;

a second piston slidably mounted within said hollow cylindrical portion of said first piston;

a first chamber defined by said hollow cylindrical portion and said second piston; a second chamber defined by said housing and said first piston;

a water-actuable chemical positioned within said first chamber which produces a gas upon contact with water;

a cartridge of compressed gas;

a piercing pin, said second piston urging said piercing pin into contact with said cartridge upon expansion of said first chamber;

first spring means urging said first piston towards said second piston;

second spring means having a greater spring constant than said first spring means urging said second piston towards said first piston;

means for allowing water to enter said first chamber;

means for allowing water to enter said second chamber; and means for closing said second chamber upon movement of said first piston away from said second piston.

10. An inflation mechanism as defined in claim 9 including a projection extending within said hollow cylindrical portion of said first piston to restrict the distance said second piston can move therein.

* * * * *